US008167489B2

(12) United States Patent
Igarashi

(10) Patent No.: US 8,167,489 B2
(45) Date of Patent: May 1, 2012

(54) PACKAGING BAG FOR SECONDARY PACKAGING CONFIGURED TO TRANSPORT INFECTIOUS SUBSTANCES

(75) Inventor: Hideo Igarashi, Chiba (JP)

(73) Assignee: Sugiyama-Gen Co., Ltd., Tokyo (JP)

( * ) Notice: Subject to any disclaimer, the term of this patent is extended or adjusted under 35 U.S.C. 154(b) by 0 days.

(21) Appl. No.: 13/166,893

(22) Filed: Jun. 23, 2011

(65) Prior Publication Data

US 2011/0317941 A1 Dec. 29, 2011

(30) Foreign Application Priority Data

Jun. 25, 2010 (JP) ..... 2010-144815

(51) Int. Cl.
*B65D 30/24* (2006.01)
*B65D 30/26* (2006.01)
*B65D 30/08* (2006.01)

(52) U.S. Cl. ..... 383/44; 383/109

(58) Field of Classification Search ..... 383/3, 43, 383/44, 78, 109
See application file for complete search history.

(56) References Cited

U.S. PATENT DOCUMENTS 3,988,873 A * 11/1976 Oliverius ..... 53/449
4,353,497 A * 10/1982 Bustin ..... 383/104
4,620,633 A * 11/1986 Lookholder ..... 206/523
4,758,099 A * 7/1988 Branson ..... 383/44
5,205,649 A * 4/1993 Fullerton ..... 383/5
5,647,480 A * 7/1997 Insley et al. ..... 206/204
2009/0028468 A1 * 1/2009 Tanaka ..... 383/52

FOREIGN PATENT DOCUMENTS

| | | |
|---|---|---|
| JP | 60-7333 | 3/1985 |
| JP | 2002-316702 | 10/2002 |
| JP | 2004-016553 | 1/2004 |
| JP | 2005-059888 | 3/2005 |
| JP | 3153217 | 8/2009 |

* cited by examiner

*Primary Examiner* — Nathan J Newhouse
*Assistant Examiner* — Nina Attel
(74) *Attorney, Agent, or Firm* — Wenderoth, Lind & Ponack, L.L.P.

(57) ABSTRACT

A packaging bag for secondary packaging which allows safety transport of infectious substances is provided. Front and back surface materials are placed on top of another and formed into a bag member by heat-sealing both side edge and bottom edge portions continuously. Partitioning materials formed of a plastic sheet or film having a required size are disposed on inner surfaces of the upper ends of the front and back surface materials and attached to the front and back surface materials by heat-sealing both side edge and bottom edge portions except for an upper end edge portion to form pocket portions. A sealing material is stuck to the back surface material on the outside of the upper end portion thereof so as not to be opened. The internal pressure is received by one of the pocket portions when the internal pressure in the packaging bag is increased.

5 Claims, 8 Drawing Sheets

PACKAGING BAG FOR SECONDARY PACKAGING CONFIGURED TO TRANSPORT INFECTIOUS SUBSTANCES

BACKGROUND OF THE INVENTION

1. Field of the Invention

The present invention relates to a packaging bag for secondary packaging configured to package and transport containers having infectious substances such as causal organisms or specimen materials stored therein safely.

2. Prior Art

In order to transport (by air transport) infectious substances, being categorized into Category A and Category B depending on the types of the corresponding infectious substances on the basis of IATA Dangerous Goods Regulations, it is made mandatory to transport with packaging infectious substances in both categories triply according to standards defined in Infectious Diseases Control Law and the like. As a primary package, for example, containers such as test tubes, blood drawing tubes, cups, or the like which can be hermetically sealed with a plug member are employed. As a secondary package, for example, resin bag members (pouches) configured to wrap the primary packaging containers with a cushion material, formed into a bag shape having hermeticity and water resistance, and meeting standards defined in Infectious Diseases Control Law and the like such as being capable of enduring temperatures between −40° C. and 55° C. and bearing a pressure difference of 95 kPa or larger with respect to an internal pressure thereof are employed. As a tertiary package, exterior containers configured to accommodate the secondary packaged substances, for example, having a relatively robust structure having water resistance, shock resistance, and heat insulating properties are employed.

As a known example of the packaging container of this type, for example, there is a transport container configured to package an infectious substance in a container and accommodate and transport the prepared package including an exterior container and a heat-insulating container matching the exterior container and configured to be loaded therein so as to be freely unloadable and accommodate the package, wherein the exterior container includes a cylindrical body formed of thick paper material such as a corrugated cardboard into a square shape having a desired size in cross section, a bottom lid portion formed of a flap continuing from one end of the body so as to be freely foldable, and an upper lid portion formed of a flap continuing from the other end of the body so as to be freely foldable, the heat insulating container includes a cylindrical body portion opening on both ends, a bottom lid portion configured to close up the opening at one end of the body portion, and an upper lid portion configured to close up the opening at the other end of the body portion, the cylindrical body portion is formed of foam paper having predetermined width and length, includes a rectangular panel member having a desired thickness, and is configured to be formed into a square shape in cross section by being folded along bending portions provided in parallel to the width direction thereof at predetermined portions so as to bring both ends of the panel member into abutment, the bottom member includes a square bottom plate formed of a material having heat insulating properties and shock absorbing properties and formed into a size meeting an end surface of the opening of the body portion at the one end, and an engaging device configured to disengageably engage the bottom plate with the opening of the body portion, the upper lid portion includes a square top plate formed of a material having heat insulating properties and coherent properties and formed into a size meeting the end surface of the opening of the body portion at the other end, and an engaging device configured to disengageably engage the top plate with the opening of the body portion (see Japanese Patent Utility Model No. 3153217).

The transport container described above is a tertiary packaging exterior container and allows transport under temperature control such that content accommodated in the heat-insulating container (packaged infectious substance) is kept cooled at a predetermined temperature. Since the plate member which forms the cylindrical body portion of the heat-insulating container can be stored in a stack, a storage space can be reduced. The bottom lid portion and the upper lid portion can also be stored in a stack. In addition, since the exterior container can be folded into a flat profile, storage in a stack in the same manner as described above is possible. Then, the transport containers can be used by being assembled when needed. Since a cushioning function (shock absorbing function) is provided, the substance accommodated therein (content) can be protected from external influences such as physical damages.

In this known example, an example of a secondary packaging container is disclosed. The container in this example employs a plastic bag (pouch). The plastic pouch is formed by polymerizing two plastic sheets and sticking peripheral edges on top, bottom, left, and right in an air-tight manner by heat sealing or the like and is configured in such a manner that, for example, a loading-and-unloading port is formed by incising one of the plastic sheets on one side at a portion near an upper end portion so as not to reach both side edge portions and a fastener is attached inside the loading-and-unloading port to allow opening and closing thereof, the fastener is made up of a projecting engaging strip and a depressed engaging strip formed of resin, and the projecting engaging strip and the depressed engaging strip are engaged into tight contact with each other by being pressed from above the sheets and disengaged from each other by being applied with a force of separating the sheets. Subsequently, the container is hermetically sealed by sticking an adhesive-backed tape to the loading-and-unloading port in a state in which the projecting engaging strip and the depressed engaging strip are engaged into tight contact with each other.

Incidentally, the secondary packaging pouch formed of plastic sheets in the known example described above, since the loading-and-unloading port is formed by incising one of the plastic sheets on one side so as not to reach the both side edge portions and, in addition, the resin fastener is attached inside the loading-and-unloading port, there are problems not only in that the loading-and-unloading port is too small to load and unload the packaged substance easily so that handling and workability are hindered, but also only in that even though the loading and unloading port is maintained in the hermetically sealed state by an engaging force between the projecting engaging strip and the depressed engaging strip of the resin fastener and an adhesive force of the adhesive-backed tape in an actual use, when the internal pressure reaches a standard pressure of 95 kPa or higher by expansion of interior air due to the temperature variations, the corresponding pressure acts on the adhesive tape directly via the fastener and the plastic sheets are expanded entirely by the expansion of the pouch, whereby the adhesive tape is peeled off by the direct pressure action and the expanding action and then the engaging strips of the fastener is separated to open the loading-and-unloading port, so that the preset standard pressure difference defined in the Infectious Diseases control Law and the like cannot substantially be supported.

As described above, the secondary packaging plastic sheets or the film-made pouch in the known example described above takes a double hermetically sealed state using an engaging force of the fastener and an adhesive force of the adhesive tape. However, in this configuration, the hermetically sealed state cannot be maintained by separation of the adhesive tape and disengagement of the engaging strips of the fastener by direct application of a pressure increased by expansion of air in the interior of the pouch due to temperature variations and the expanding action due to the expansion of the pouch, and hence reliability is not sufficient for being used for transporting the infectious substances.

SUMMARY OF THE INVENTION

It is a principal object of the invention to provide a packaging bag for secondary packaging in which a loading-and-unloading port is not opened even when a standard internal pressure defined in Infectious Diseases Control Law and the like reaches a pressure of 95 kPa or higher.

It is another object of the invention to provide a packaging bag for secondary packaging in which an opening (loading-and-unloading port) for allowing loading and unloading of a packaged substance is configured so that one side surface (upper end edge portion) of a container (pouch) is opened entirely, so that handling of the bag and loading-and-unloading workability are facilitated.

As a specific measure for solving the above-described problem, there is provided a packaging bag for secondary packaging to be accommodated in a transport container configured to transport infectious substances in primary packaging, secondary packaging, and tertiary packaging, including: a front surface material and a back surface material formed of a plastic sheet or film placed on top of another, the front surface material and the back surface material being formed into a bag member by heat-sealing both side edge portions and a bottom edge portion except for an upper end edge portion which becomes an opening continuously; partitioning materials having a required size and formed of a plastic sheet or film being disposed respectively on inner surfaces of the front surface material and the back surface material on the side of upper ends thereof, the partitioning materials being attached respectively to the front surface material and the back surface material by heat-sealing the upper end edge portion and the both side edge portions to form pocket portions; a sealing material to be attached with an adhesive device to the back surface material on the outside of an upper end portion thereof so as to prevent the opening from opening, wherein a surface contact between the partitioning materials is maintained when an internal pressure in the packaging bag is increased, and the corresponding internal pressure is received by any one of the pocket portions.

Preferably, the front surface material and the back surface material is formed of a single plastic sheet or film continued by a bottom member folded back by a required length, and side surface portions of the bottom material folded back by the required length are heat-sealed to the front surface material and the back surface material respectively so that the bottom edge portion is widened in a ship's bottom shape.

Preferably, sides of the partitioning materials which come into surface contact are formed of a material providing high conformability between the materials, and preferably, the partitioning materials have a length (width) corresponding to ¼ to ½ of the length of the opening of the packaging bag.

Preferably, the plastic sheet or film has a three-layer structure having a nylon core material integrally laminated with polyethylene layers on both surfaces.

ADVANTAGES OF THE INVENTION

According to the packaging bag for secondary packaging according to the invention, even when the internal pressure of the packaging bag is increased to a reference value of 95 kPa or higher defined by Infectious Diseases Control Law and the like due to the influence of the external air temperature during transport, the corresponding internal pressure is received by the pocket portion provided on the opening side. Therefore, the opening, that is, the loading-and-unloading port is not opened, and the heat seal portion of the packaging bag is not peeled off, so that a superior effect such that the infectious substances can be transported safely is achieved.

In addition, since the opening provided on one side surface of the packaging bag, that is, at the upper end edge portion can be opened entirely, another superior effect such that loading and unloading operations or handling of packaged substances such as the infectious substances can be performed easily is achieved.

DETAILED DESCRIPTION OF THE INVENTION

Figure 1:
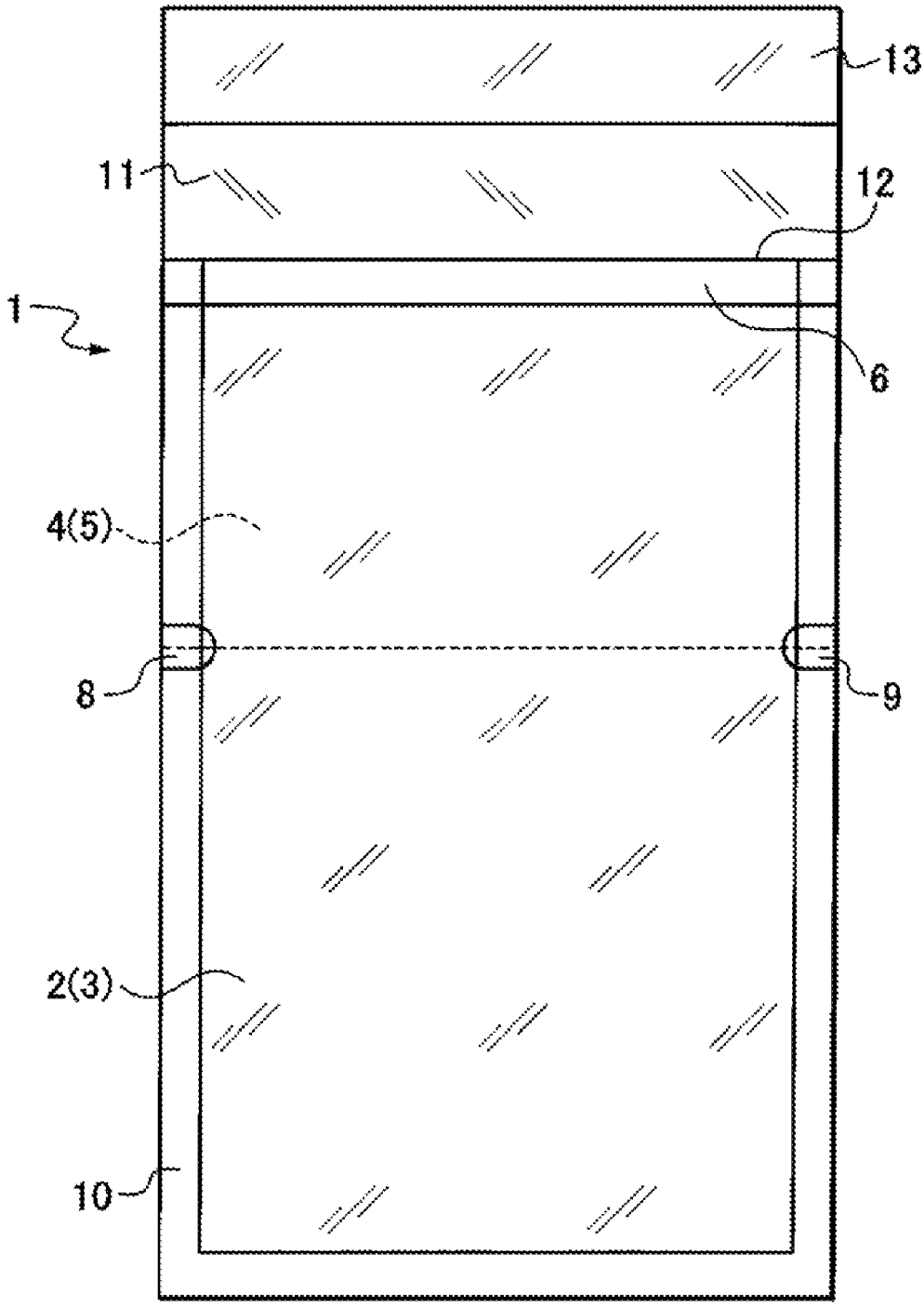
FIG. 1 is a plan view showing a packaging bag for secondary packaging according to a first embodiment of the invention.
Figure 2:
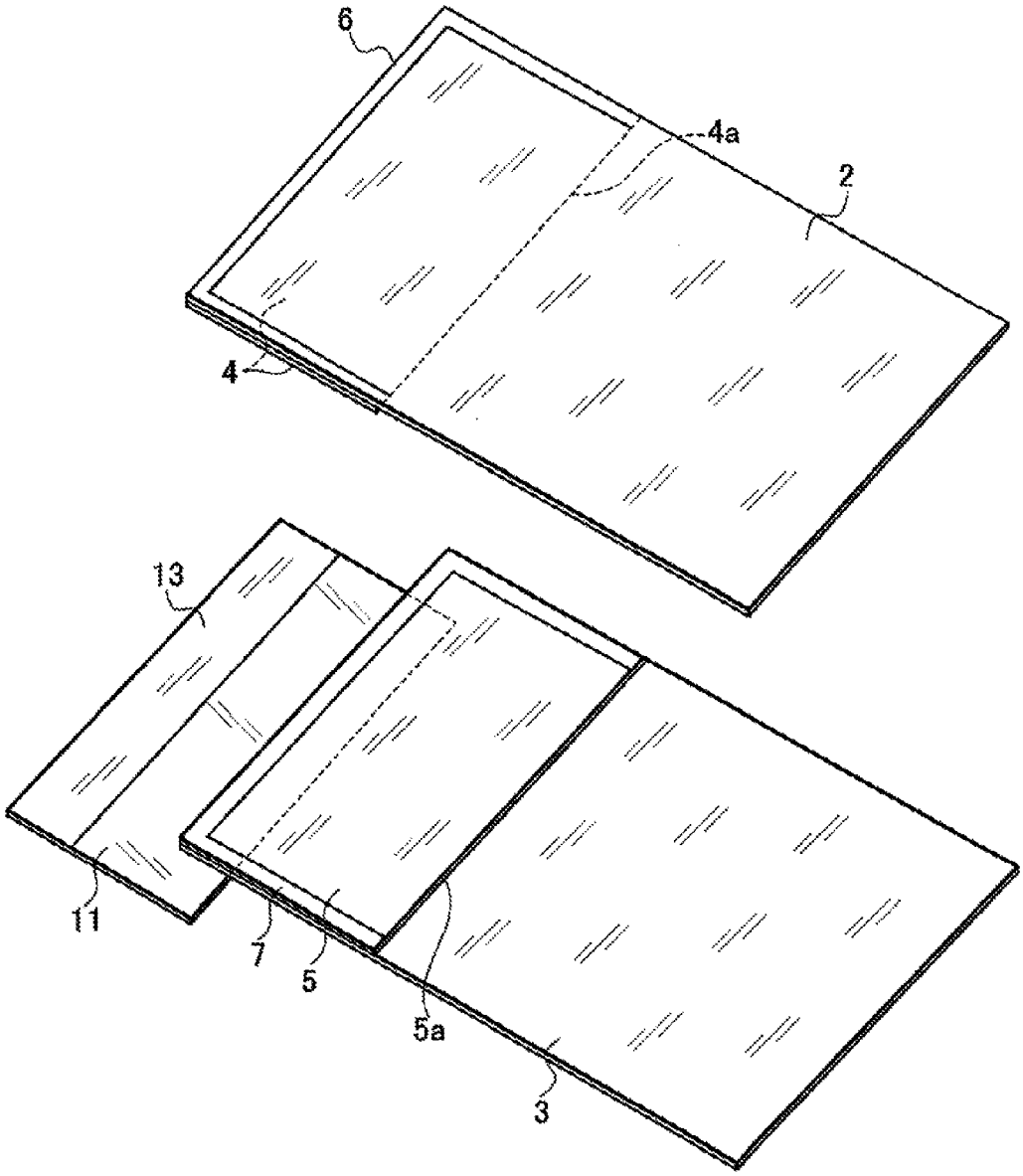
FIG. 2 is a perspective view of the same packaging bag with a plastic sheet or film as a component thereof separated therefrom.
Figure 3:
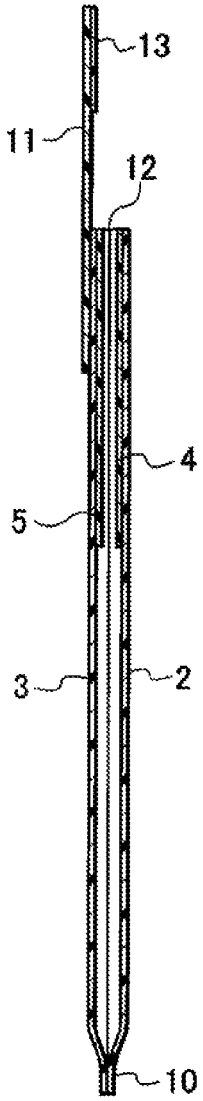
FIG. 3 is a schematic vertical cross-sectional view of the same packaging bag for understanding the structure thereof.

FIGS. 1 to 3 show a packaging bag 1 for secondary packaging according to a first embodiment of the invention, which is formed into a bag member by placing a front surface material 2 and a back surface material 3 being formed of two rectangular plastic sheets or films having the same size one on top of another, and heat-sealing three side edges. Partitioning materials 4 and 5 formed of a plastic sheet or film and having a required size are placed on top of the front surface material 2 and the back surface material 3 respectively on upper end portions thereof where an opening is formed, and sealed portions 6 and 7 are formed by continuously heat-sealing upper end edge portions and both side edge portions respectively, whereby pocket portions 4*a* and 5*a* are formed respectively, as shown in FIG. 2.

Then, the front surface material 2 and the back surface material 3 are placed on top of one another with the sides of the partitioning materials 4 and 5 facing each other, sealed portions 8 and 9 are formed by heat-sealing the both side edge portions respectively to make these portions flat to some extent in order to eliminate a level difference generated at the both side edge portions where the pocket portion 4*a* and 5*a* formed, then the both side edge portions and the bottom edge portion except for the upper end edge portion are heat-sealed continuously to form a sealed portion 10, whereby a bag member, namely, the packaging bag 1 is formed. Here, the length of extension of the partitioning materials 4 and 5 into the bag member is approximately a range from ¼ to ½ of the width of the opening of the packaging bag 1, and extends to at least about ⅓ of the height of the bag member.

A sealing material 11 formed of a plastic sheet or film formed into a rectangular shape of a required size is integrally attached to the outside of the upper end portion of the back surface material 3 of the packaging bag 1 formed in this manner with an adhesive agent or the like. The sealing material 11 is configured to be folded after having accommodated the infectious substance, which is a packaged substance, in the interior of the packaging bag 1 so as to cover an opening 12 of the packaging bag 1 entirely, and stuck to the front surface material 2 via a suitable adhesive device to hold the opening 12 so as not to open.

As an example of the adhesive device in this case, the opening 12 of the packaging bag 1 at the upper end edge portion can be held so as not to open by, for example, printing an adhesive layer 13 having a required width on a free end side of the sealing material 11 and attaching a protective film having release properties to the adhesive layer 13, or by sticking a double-faced adhesive tape including the adhesive layer 13 and a release coated paper is attached in advance, folding the sealing material 11 on the side of the front surface material 2, peeling off the protective film or the release coated paper, attaching the adhesive layer 13 to the front surface material 2, thereby fixing the sealing material 11.

Figure 4:
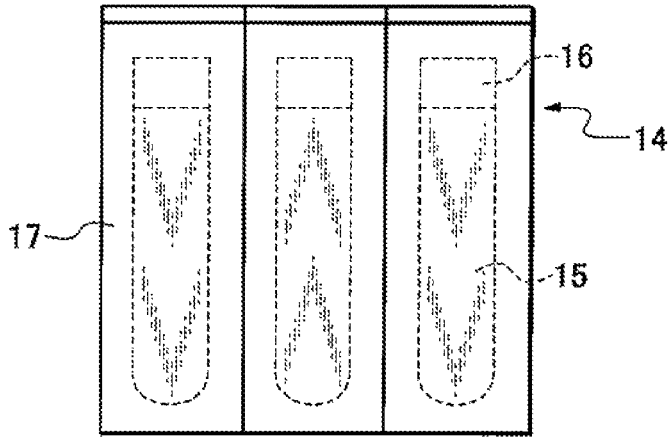
FIG. 4 is a schematic plan view showing a packaged state of primarily packaged infectious substances to be accommodated in the same packaging bag.

The infectious substance to be accommodated in the packaging bag 1 for secondary packaging according to the first embodiment is accommodated in the packaging bag 1 as a primarily packaged package 14, as shown in FIG. 4. The primarily packaged package 14 is prepared, for example, by putting the infectious substance into a test tube 15, hermetically sealing the test tube 15 with a lid member 16, and packaging the entirely safely with a packaging material 17 having cushioning properties and liquid absorbing properties, and is primarily packaged in the same manner as in the prior art.

Figure 5:
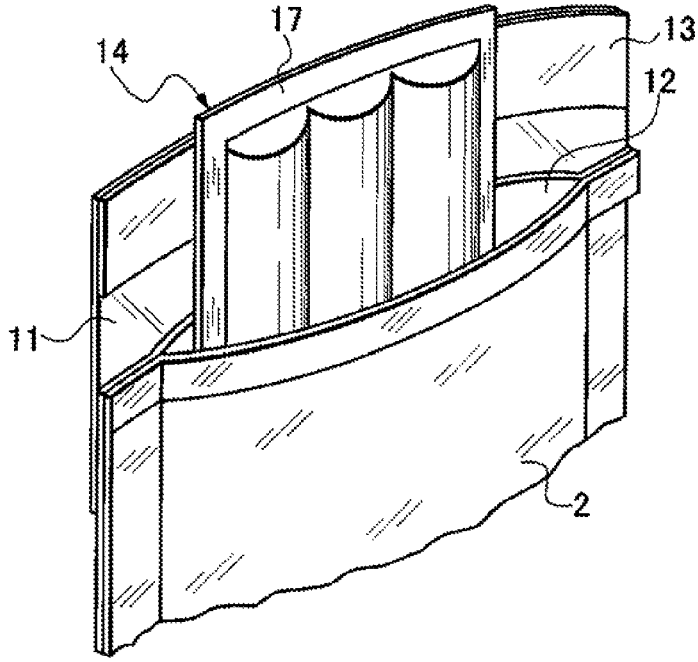
FIG. 5 is a perspective view showing a state in which the primarily packaged infectious substances are about to be accommodated in the same packaging bag.
Figure 6:
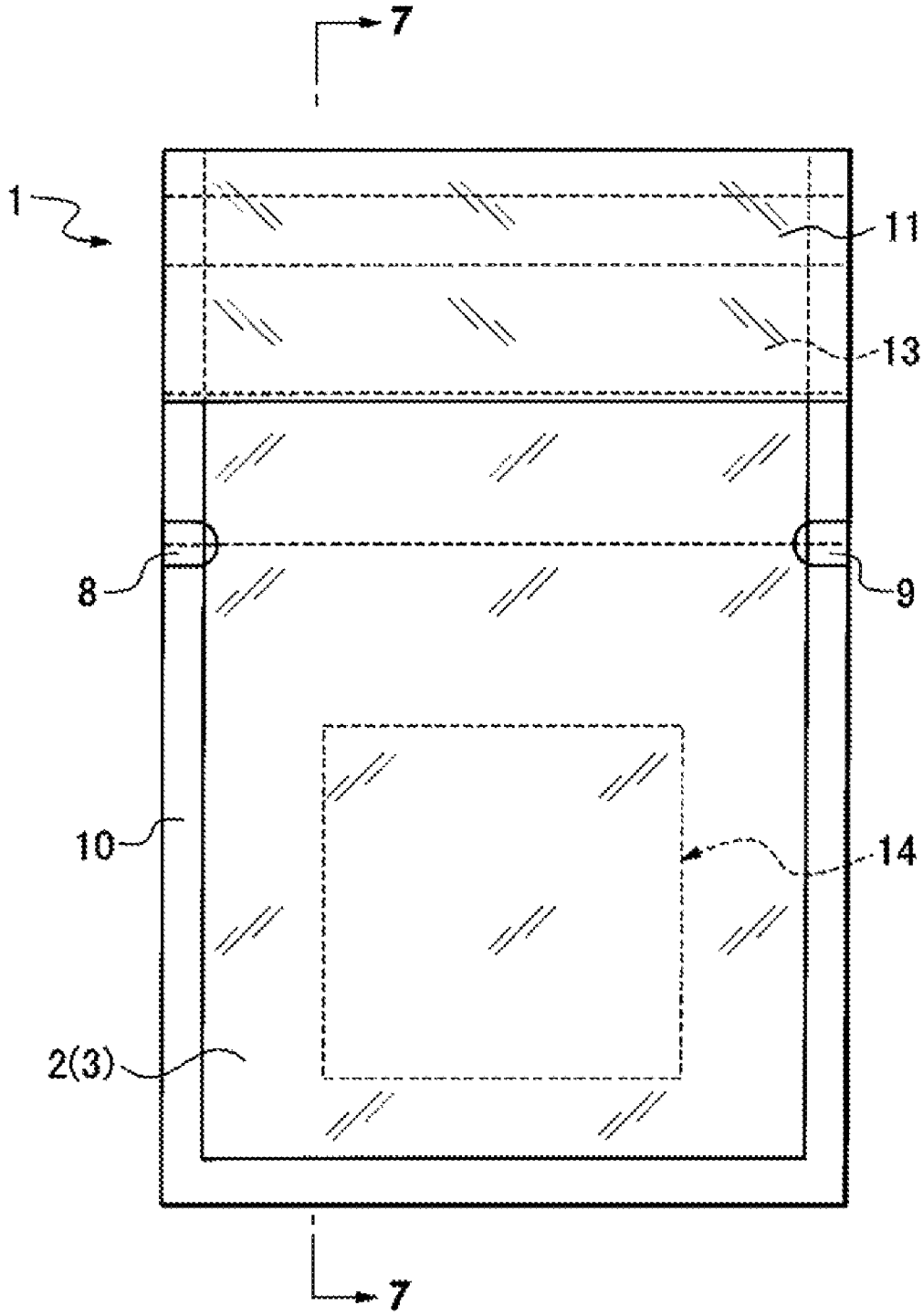
FIG. 6 is a plan view showing a state in which the primarily packaged infectious substances are accommodated in the same packaging bag.
Figure 7:
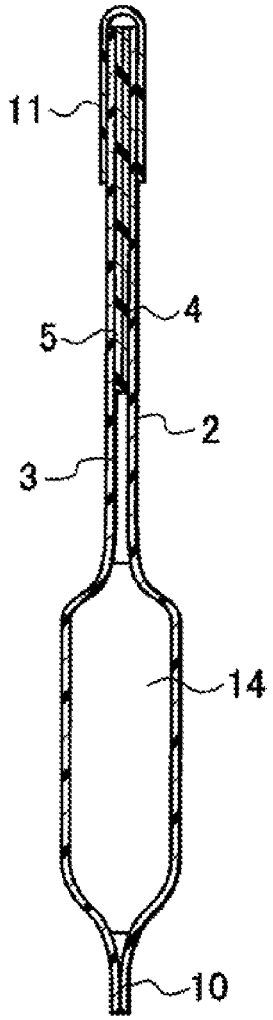
FIG. 7 is a cross-sectional view taken along the line 7-7 in FIG. 6.

The opening 12 of the packaging bag 1 is opened and the package 14 of the infectious substance primarily packaged in this manner is placed therein from the opening 12 with a sufficient room as shown in FIG. 5. Then, the package 14 is pushed to be positioned in an accommodating portion on the bottom side of the packaging bag 1 which occupies about ⅔ of the packaging bag 1 by being passed through the partitioning materials 4 and 5 as shown in FIG. 6. Then, in a state in which air in the packaging bag 1 is expelled to a certain extent, the sealing material 11 is folded to the side of the front surface material 2, the protective film or the release coated paper is peeled off to allow the adhesive layer 13 to be stuck to the front surface material 2, to hold of fix the same so as to prevent the opening 12 from opening. Consequently, the secondary packaging is completed as shown in FIG. 7. Then, the secondary packaged infectious substance is(are) accommodated in a tertiary packaging container (exterior container) having a required strength and is transported as in the prior art.

Figure 8:
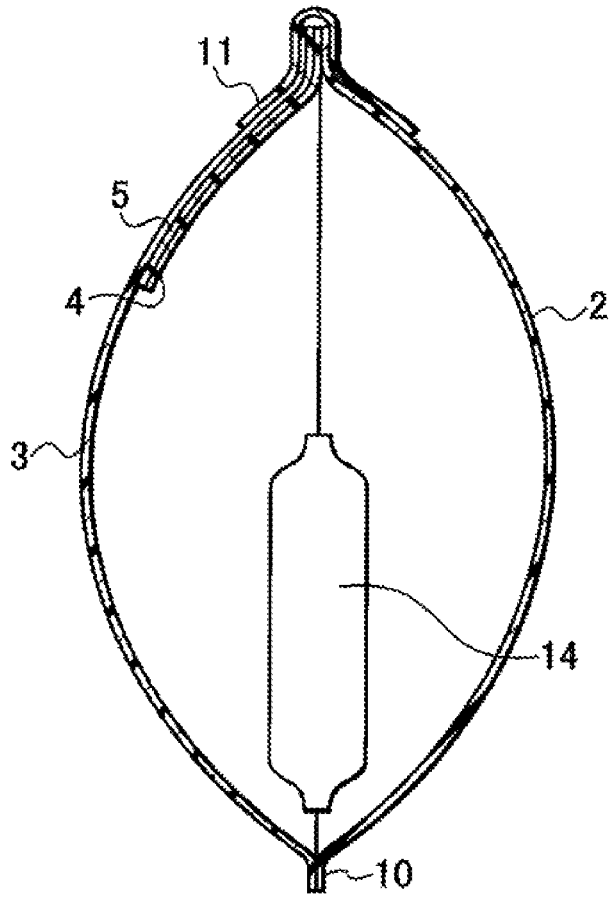
FIG. 8 is a schematic vertical cross-sectional view showing a state in which an internal pressure is increased by expansion of internal air in the packaging bag due to the external temperature in the packaged state shown in FIG. 7.

Next, a circumstance in which the air in the packaging bag 1 for secondary packaging is expanded and the internal pressure is increased to a pressure of 95 kPa or higher defined in the Infectious Diseases Control Law and the like due to the variations in external air temperature during transport, specifically, increase in external air temperature in a tropical region will be described with reference to FIG. 8.

When the air in the packaging bag 1 is expanded, the entire packaging bag 1 is expanded, and hence side surfaces formed with the sealed portions 10 approach inward entirely by this expansion. The partitioning materials 4 and 5 provided insides keep a state of surface contact due to the approach, and are deformed in a state of being in surface contact with any one of the front surface material 2 and the back surface material 3. In other words, since the partitioning materials 4 and 5 are formed to have length or width on the order of ¼ to ½ of the length (width) of the opening 12 of the packaging bag 1, that is, to be long or wide so as to extend by approximately ⅓ of the height of the packaging bag 1, the partitioning materials 4 and 5 are always in the state of surface contact. With the increase in pressure in the interior, the tight contact state (tight contact pressure) of the surface contact between the partitioning materials 4 and 5 is further increased and are strongly pressed against the back surface material 3 on one side for example as illustrated in the drawing, which only increases the degree of tight contact therebetween, and little action of the pressure in the interior is applied to the sealing material 11. Therefore, an action to push the loading-and-unloading port, that is, the opening 12 outward is not applied and hence the opening 12 is not opened, and hence the increased pressure in the interior of the packaging bag 1 is received naturally by the pocket portion 4*a* of the partitioning material 4. Since the adhesive force of the respective sealed portion is strong, the packaging bag 1 has no risk of a burst.

Subsequently, a packaging bag 21 for secondary packaging according to a second embodiment will be described with reference to FIGS. 9 to 11. The packaging bag 21 is configured to accommodate a large quantity of infectious substance (50 to 150 pieces in the case of the test tubes), and a bottom portion of the bag member is formed into a pouch shape which is opened like a ship's bottom. Basic configurations other than the pouch shape of the bottom portion are substantially the same as those in the first embodiment described above, the same reference numerals are assigned for description.

Figure 9:
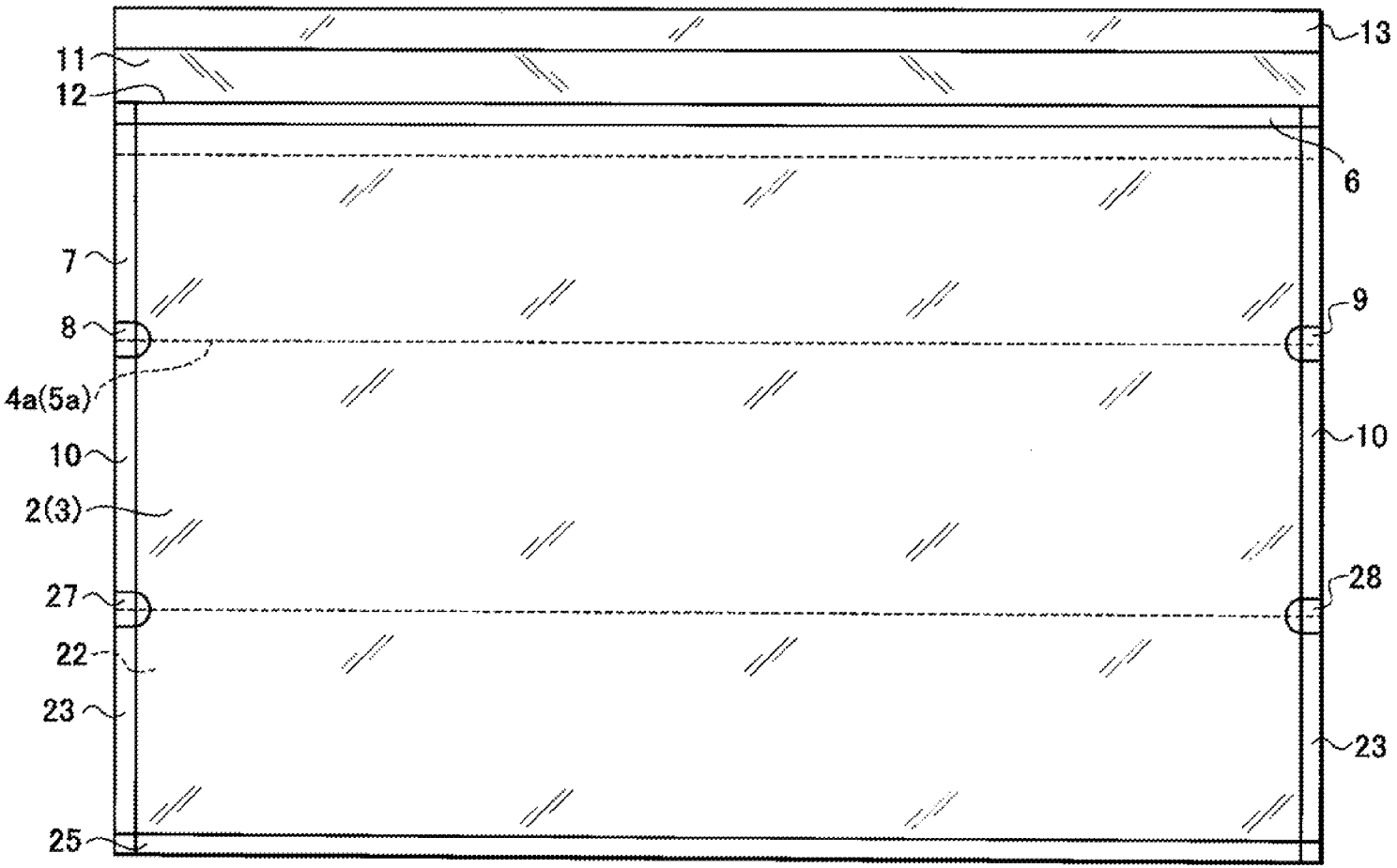
FIG. 9 is a plan view showing a packaging bag for secondary packaging according to a second embodiment of the invention.

As shown in FIG. 9, the packaging bag 21 is long in the width direction and short in the height direction as a whole, and dimensions in width×height×bottom opening are on the order of 550 mm×350 mm×230 mm, for example. However, it is needless to say that the invention may be implemented while changing these dimensions as needed.

Figure 10:
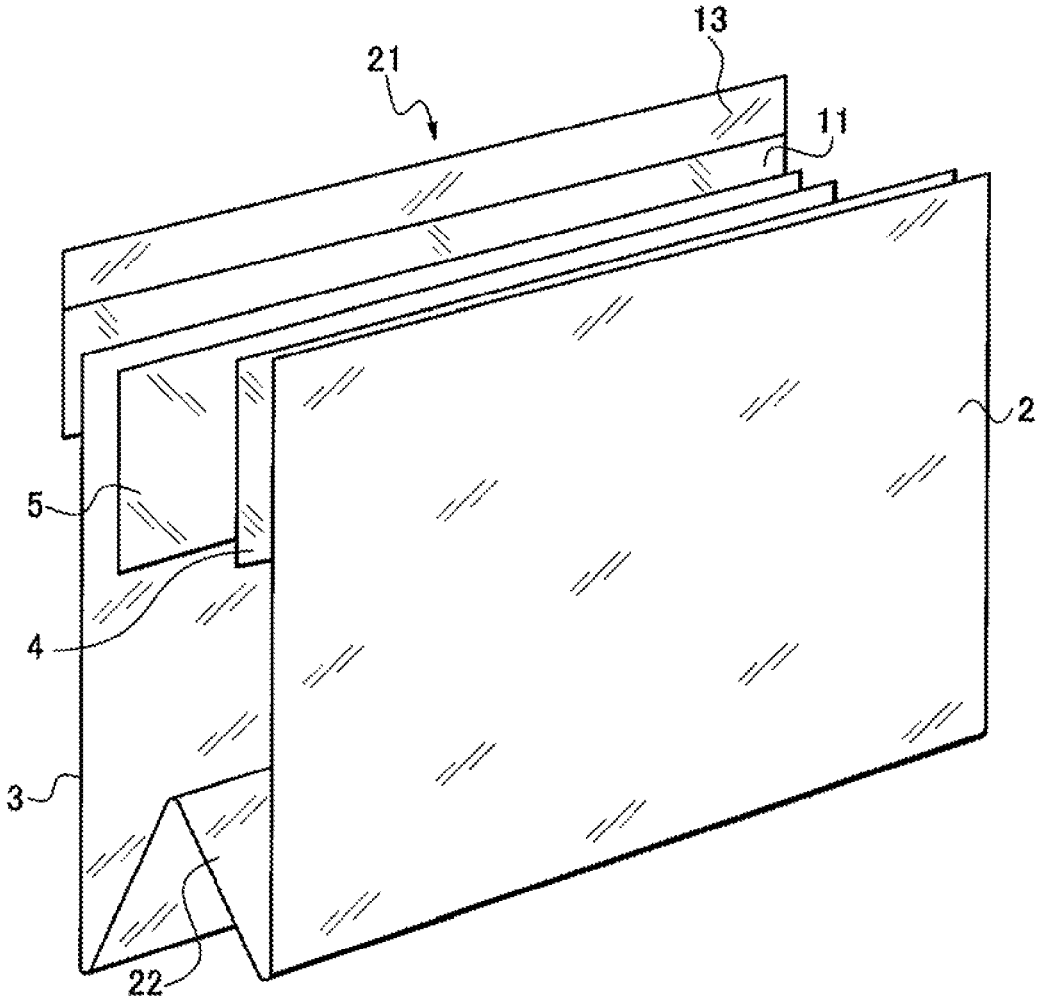
FIG. 10 is a perspective view of the same packaging bag with the plastic sheet or film as a component thereof separated therefrom.
Figure 11:
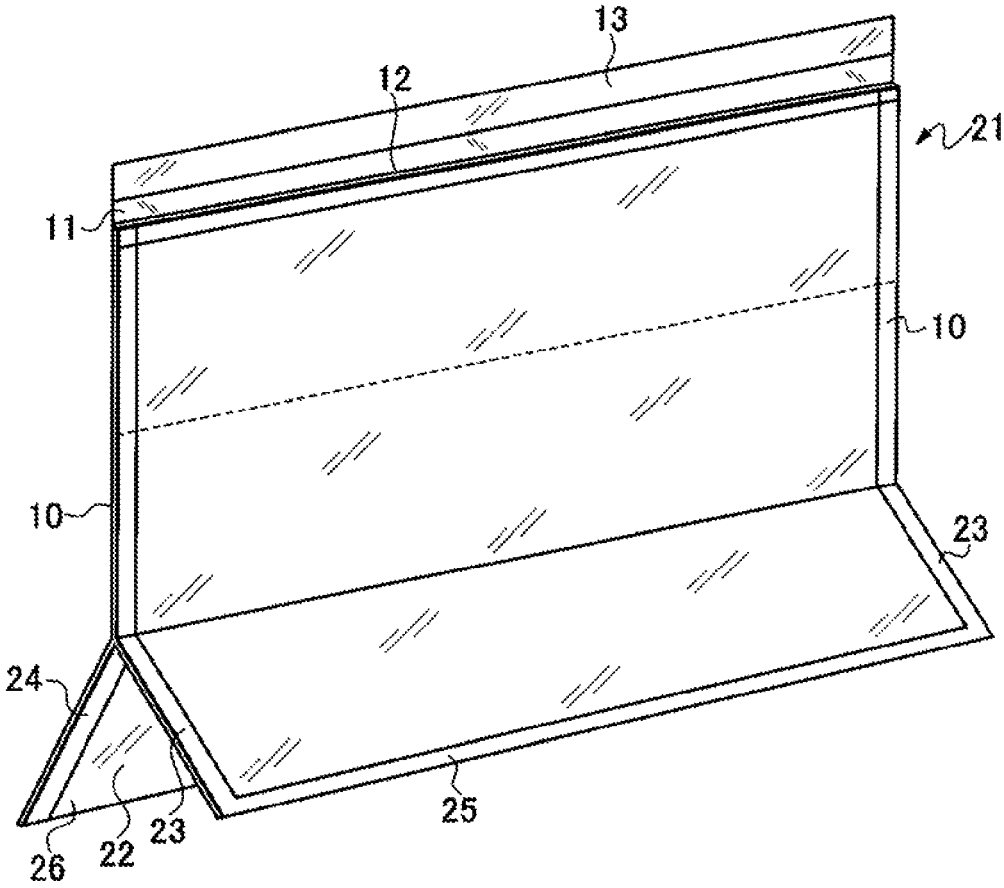
FIG. 11 is a schematic perspective view showing a state of using the same packaging bag.

Then, as shown in FIG. 10, the front surface material 2 and the back surface material 3 are formed of one piece of plastic sheet or film material continuously via a bottom edge member 22 folded back by a required length. The bottom edge member 22 folded back by the required length in this case is continued between the front surface material 2 and the back surface material 3 by being folded back inwardly, and the length of the folded back portion is substantially on the order of ⅓ of the height of the packaging bag 21. The bottom edge member 22 is formed with sealed portions 23 and 24 respectively by heat sealing the front surface material 2 and the back surface material 3 individually, and lower end portions of the front surface material 2 and the back surface material 3 are formed with sealed portions 25 and 26 respectively by heat sealing individually. The sealed portions 25 and 26 serve to improve the strength of the folded back portions at boundaries with respect to the bottom edge member 22.

Subsequently, the partitioning materials 4 and 5 are disposed respectively inside the front surface material 2 and the back surface material 3 where the opening 12 on the upper end edge of the packaging bag 21 is formed, and an upper end edge portion and both side edge portions are formed with the sealed portions 6 and 7 by being continuously heat-sealed, thereby forming the pocket portions 4*a* and 5*a* respectively as in the first embodiment described above.

Then, the front surface material 2 and the back surface material 3 are placed on top of another with the sides of the partitioning materials 4 and 5 faced each other, and since the level difference is generated at positions where the pocket portions 4*a* and 5*a* are formed and at the boundary position between the sealed portions 23 and 24 on the bottom edge member 22, the both side edge portions are formed with spot-sealed portions 8, 9, 27, and 28 respectively in a spot shape by heat-sealing the positions of and are made flat to some extent for the purpose of eliminating a level difference generated at these portions, then the both side edge portions except for the upper end edge portion, the bottom edge portion, and the sealed portions 23 and 24 are heat-sealed to form the sealed portions 10, whereby a bag member, namely, the packaging bag 21 is formed. The sizes or the breadth of the partitioning materials 4 and 5 are formed to be the length (width) on the order of ¼ to ½ of the length of the packaging bag 1 as in the first embodiment described above, and extend to approximately on the order of ⅓ of the packaging bag 1 in the height direction.

The sealing material 11 formed of a plastic sheet or film formed into a rectangular shape of a required size is integrally attached to the outside of the upper end edge portion of the back surface material 3 of the packaging bag 21 formed in this manner with the adhesive agent or the like. The sealing material 11 is formed with the adhesive layer 13 having a required width by printing in advance and the adhesive layer 13 is protected with a protective film having release properties or, alternatively, a double-faced adhesive tape including the adhesive layer 13 and a release coated paper is stuck in advance and, when in use, the sealing material 11 is folded so as to cover the opening 12 at the upper end edge of the packaging bag 21 entirely, after having accommodated the infectious substance as the packaged substance in the interior of the packaging bag 21, then the protective film or the release coated paper is peeled off to allow the adhesive layer 13 to be stuck to the front surface material 2 to hold the same so as to prevent the opening 12 from opening.

The plastic sheet or film used in the invention is preferably "sealant PE film" manufactured by Tamapoly Co., Ltd, product names "SB-5", "SB-7", and "SB-10". These products have a three-layer structure including a nylon core material integrally laminated with polyethylene layers on both surfaces, which is usable with a thickness ranged from 30 to 150 μm, is strong and flexible with low degree of elongation, and is superior in low temperature sealing properties. The material used for the front surface material 2 and the back surface material 3 is preferably PET20/NY20/LLDPE70, and LLDPE30/NY20/LLDPE70 may be used for the partitioning materials 4 and 5. In particular, surface contact properties are further improved by adding EVA to LDPE30 on the surface-contact side by an amount ranging from 3 to 10%. A film of PP60 is used as the sealing material 11, because it is used simply for maintaining the closed state of the opening 12. However; the invention is not limited thereto.

In this manner; by selecting the materials to be used, the characteristics as the packaging bags 1 and 21, in particular, high strength and reduction of degree of elongation, high heat-sealing strength without the probability of being peeled off, and high closed-state maintaining function to prevent the opening 12 from opening due to the temperature variations are achieved. In addition, for example, by the existence of LLDPE (straight-chain low-density polyethylene layer) on the front surface layer of the sheet or film used as the partitioning materials 4 and 5, favorable conformability of the surface contact therebetween is achieved. In addition, by adding EVA, which is a material providing high conformability between materials to LLDPE on the side of the surface contact by an amount ranging from 3 to 10%, the degree of tight contact of the surface contact therebetween is further increased when the internal pressure is increased, so that the opening 12 is prevented from being opened.

INDUSTRIAL APPLICABILITY

The packaging bag for secondary packaging according to the invention is provided with the pocket portions formed by providing the partitioning materials inside the portion to be formed with the opening in cooperation of the front surface material and the back surface material which constitute the bag member. Therefore, even when the internal pressure in the packaging bag is increased to a reference pressure of 95 kPa or higher, the internal pressure is received by the pocket portions provided on the opening side entirely, which is defined in the Infectious Diseases Control Law and the like, due to the temperature variations, without providing an additional fastener or the like. Therefore, the packaged substance can be transported safely without opening of the opening or burst of the packaging bag and, in particular, the invention can be widely used when transporting the infectious substance by air to areas or regions subjected to significant temperature variations.

What is claimed is:

1. A packaging bag for secondary packaging to be accommodated in a transport container configured to transport an infectious substance in primary packaging, secondary packaging, and tertiary packaging, the packaging bag comprising:

a front surface material and a back surface material, the front surface material being placed on top of the back surface material, the front surface material and the back surface material being formed into a bag member by heat-sealing both side edge portions and a bottom edge portion, and an opening being provided at an upper end edge portion of the bag member by not heat-sealing the upper end edge portion;

partitioning materials disposed respectively on inner surfaces of the front surface material and the back surface material on the side of upper ends which corresponds to the opening, the partitioning materials being attached respectively to the front surface material and the back surface material by heat-sealing the upper end edge portion and the both side edge portions to form pocket portions; and a sealing material for being stuck with an adhesive device to the back surface material on the outside of an upper end portion thereof so as to close the opening, wherein a surface contact between the partitioning materials is maintained even when an internal pressure in the packaging bag is increased such that a pressure difference with respect to the internal pressure reaches 95 kPa or larger, and the corresponding internal pressure is received by any one of the pocket portions, wherein a length of the partitioning materials is ¼ to ½ of a length of the opening of the packaging bag, wherein each of the front surface material and the back surface material is formed of a plastic sheet or film which has a three-layer structure of PET20/NY20/LLDPE70, and wherein each of the partitioning materials is formed of a plastic sheet or film having a three-layer structure of LLDPE30/NY20/LLDPE70, and the LLDPE30 layer on the surface-contact side contains EVA in an amount of 3 to 10%.

2. The packaging bag for secondary packaging according to claim 1, wherein the front surface material and the back surface material are formed of a single plastic sheet or film, and the single plastic sheet is folded back at a bottom portion of the bag member, and wherein side surface portions of the bottom member are respectively heat-sealed to the front surface material and the back surface material so that the bottom edge portion is widened in a ship's bottom shape.

3. The package bag for secondary packaging according to claim 1, wherein sides of the partitioning materials which come into surface contact are formed of a material providing high conformability between the materials.

4. The packaging bag for secondary packaging according to claim 1, wherein the plastic sheet or film of each of the front surface material, the back surface material, and the partitioning materials has a thickness of 30 to 150 μm.

5. The packaging bag for secondary packaging according to claim 1, wherein the front surface material and the back surface material are formed of a single plastic sheet or film, and the single plastic sheet is folded back at a bottom portion of the bag member, and wherein side surface portions of the bottom member are respectively heat-sealed to the front surface material and the back surface material so that a bottom portion of the bag member has a pouch shape.

* * * * *